US006085758A

United States Patent [19]

Bermudez

[11] Patent Number: 6,085,758

[45] Date of Patent: Jul. 11, 2000

[54] HAIR ROLLER AND APPLICATOR

[76] Inventor: May A. Bermudez, 10100 Fleming Ave., Bethesda, Md. 20814

[21] Appl. No.: 09/263,945

[22] Filed: Mar. 8, 1999

[51] Int. Cl.[7] ..... A45D 2/24; A45D 24/00; A46B 29/17

[52] U.S. Cl. ..... 132/262; 132/150; 15/176.1

[58] Field of Search ..... 132/262, 245, 132/250, 222, 267, 268, 226, 247, 237, 238, 239, 240, 241, 223, 242, 150; 15/176.6, 176.1

[56] References Cited

U.S. PATENT DOCUMENTS

| | | | |
|---|---|---|---|
| 3,123,080 | 3/1964 | Brenn-albertoni | 132/226 |
| 3,438,382 | 4/1969 | Solomon | 132/226 |
| 3,624,749 | 11/1971 | Girard | 132/226 |
| 3,675,663 | 7/1972 | Calandra | 132/226 |
| 3,987,805 | 10/1976 | Schuster | 132/40 |

FOREIGN PATENT DOCUMENTS

| | | | |
|---|---|---|---|
| 1022388 | 3/1966 | Italy | 132/242 |

*Primary Examiner*—John J. Wilson
*Assistant Examiner*—Robyn Kieu Doan
*Attorney, Agent, or Firm*—Dennison, Scheiner, Schultz & Wakeman

[57] ABSTRACT

A hair curler and an applicator therefor, the hair curler formed from a hollow cylinder of a Velcro®-type material having a plurality of filaments protruding from its external surface. Where the applicator is to be used by a hair dresser, it is a hollow cylinder of rigid material, freely slidable within the hair curler. Where the curler is to be applied by the user, the applicator is formed with a handle portion and a roller portion, and is formed of a resilient material which can be reduced in diameter upon application of pressure.

16 Claims, 3 Drawing Sheets

HAIR ROLLER AND APPLICATOR

BACKGROUND OF THE INVENTION

The invention relates to the field of hair curlers made of a self-gripping tape or fabric.

Hair curlers made of a self-gripping tape or fabric of the Velcro® type are well-known. For example, U.S. Pat. No. 3,123,080 discloses a band of fabric which is glued, welded, hooked or sewn to a cylindrical body which can be rigid or deformable plastic foam. According to U.S. Pat. No. 3,267,942, a fabric cylinder is made self supporting by insertion of reinforcement rings.

U.S. Pat. No. 3,438,382 discloses a hair curler in which the fabric is secured to a hollow curler of body by passing the end of the strips of fabric through slots in the curler body.

U.S. Pat. No. 5,660,192 discloses a hair curler having a foam plastic roller on which a self-gripping tape is seated. The tape may be bonded to the roller with adhesive.

U.S. Pat. No. 5,799,670 discloses a curler having a Velcro type surface which is used in conjunction with a control wand. The curler includes an aperture which is identical in shape and width to the control wand so that the curler can slide along the wand. The wand includes a release stop means enabling the curler to be secured on and removed from the wand.

While the use of a wand enables easier application of the curler, the configuration of the curler increases both its weight and the likelihood that an additional means will be required to secure the curler to the hair. While the combination of the fabric and foam provides a lighter curler, the foam required nevertheless increases of both the size of each curler and its cost.

SUMMARY OF THE INVENTION

It is therefore in an object of the invention to provide a hair curler which is very light in weight.

Is a further object of the invention to provide a lightweight hair curler utilizing a separate applicator for easy application.

To achieve these and other objects, the invention provides a combination of hair curler and applicator in which the hair curler is formed from a cylinder of a Velcro®-type fabric or tape, in which the exterior surface is covered with fastening elements. In this manner, the hair curler maintains a very light weight that enhances the self fastening effect. The lightness provides more stability to keep the curler in place more effectively, in contrast to heavier curlers that may wobble, requiring reinforcement with a net or clips. Because the hair curler of the invention is deliberately flimsy, it requires a rigid applicator to facilitate the rolling process.

In a first embodiment, where the curler is to be applied by a hair dresser, the applicator can be a rigid cylinder of plastic of diameter slightly less than the curler and length slightly greater than the curler, and which includes means on each end to assist the hair dresser in gripping the applicator.

In another embodiment, where the curler is to be applied to the user's own hair, the applicator is formed of a rigid, deformable material such as a hard rubber, and includes a handle. When the curler is wound around the hair, the applicator may be removed from the curler by application of pressure to lines of deformation.

DESCRIPTION OF THE PREFERRED EMBODIMENTS

Figure 1:
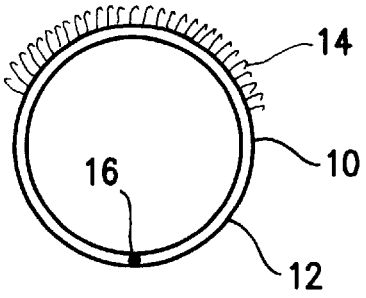
FIG. 1 is an end view of a curler according to the invention.

The basic curler 10 of the invention, shown in FIG. 1, includes a fabric strip 12 having hook-shaped protrusions 14, wound into a cylindrical shape and secured along a line 16 with stitching, adhesive or any other commonly used means of securing. It is understood that the fabric strip 12 is any fabric or tape which grips the hair. This fabric of tape is generally described as being of the Velcro®-type, having either closed or open loops, or monofilament threads, straight or with bulbous ends. The hooks and loops may be singular or arranged in pairs about 1 mm apart, or in vertical rows, parallel to each other, about 2 mm apart. The curler may have a combination of the two types of filaments. Where the fabric 12 is a sufficiently heavy, no reinforcement will be needed.

Figure 2:
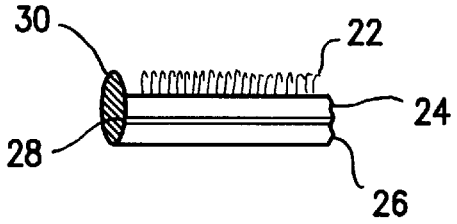
FIG. 2 is an enlarged, cross-sectional view of a material used to form a curler.

If the fabric 12 is considered excessively flimsy for its purpose, a reinforced material as shown in FIG. 2 will be used. The material of FIG. 2 includes hooks or loops 22 secured in fabric or tape 24 which is secured to a reinforcing layer 26 by an adhesive layer 28; alternatively, the layers can be sewn together. Regardless of whether one or two layers are used, the curler should be extremely light in weight and entirely flexible, i.e. not rigidified. The end of the curler may be left flat, or may be rolled on itself, as shown in FIG. 2, to form an end portion 30 about 1 mm in thickness.

Although the curler will generally have filaments protruding from the entirety of its external surface, this is not required, and the filaments may protrude from only a portion of the external surface, in any desired pattern.

The hair curler can be provided in a variety of lengths and diameters as is known in the art. In a typical configuration, the curler will be about 30 mm in diameter and about 60 mm in length.

Figure 3:
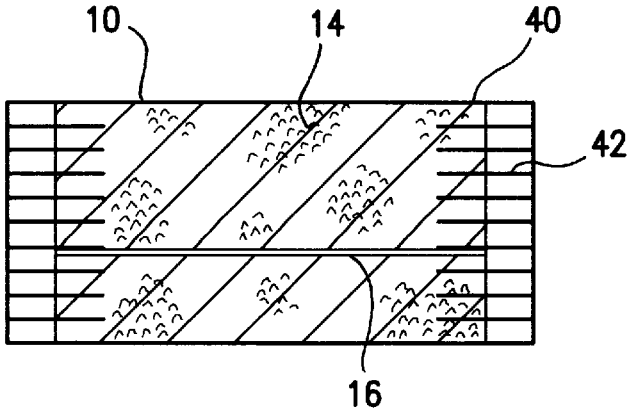
FIG. 3 is a plan view of a curler in combination with an applicator of a first type.

FIG. 3 shows the curler of FIG. 1 in combination with an applicator used by a hair dresser. Applicator 40 is a rigid plastic cylinder about 1.5 to 2 mm smaller in diameter than the curler; assuming the above dimensions for the curler, the diameter of the applicator is about 28 mm. The applicator must have a wall of sufficient thickness that it is rigid, and will typically be about 2 mm in thickness, although this should not be considered limiting as lesser and greater thicknesses may also be acceptable. The applicator should be at least as long as the curler, and will typically be at least 5 mm longer in order to make it easier to grip.

The ends of the applicator should be provided with a means to make the applicator easier to grip. As shown in FIG. 3, the exterior surface of the applicator is provided with a series of longitudinal ranges about 1 mm in thickness and about 1–1.5 cm in length.

Figure 4:
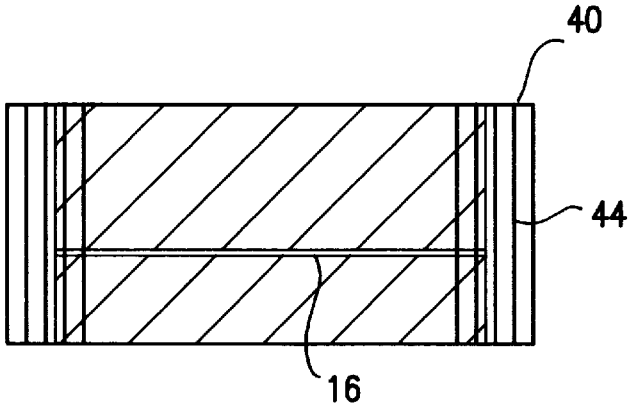
FIG. 4 is a cut away, interior view of the applicator shown in FIG. 3.

The internal surface on the applicator is shown in FIG. 4. In order to aid gripping, the internal surface is provided with a series of transverse ridges about 1 mm in thickness and about 2 millimeters apart.

Figure 5:
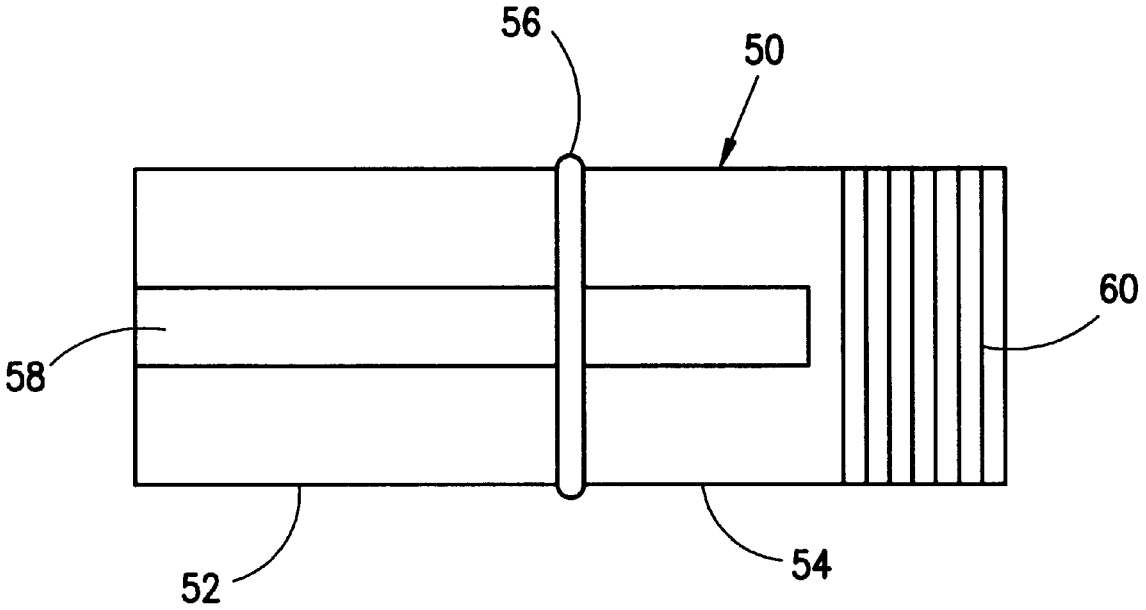
FIG. 5 is a plan view of an applicator of a different type.
Figure 6:
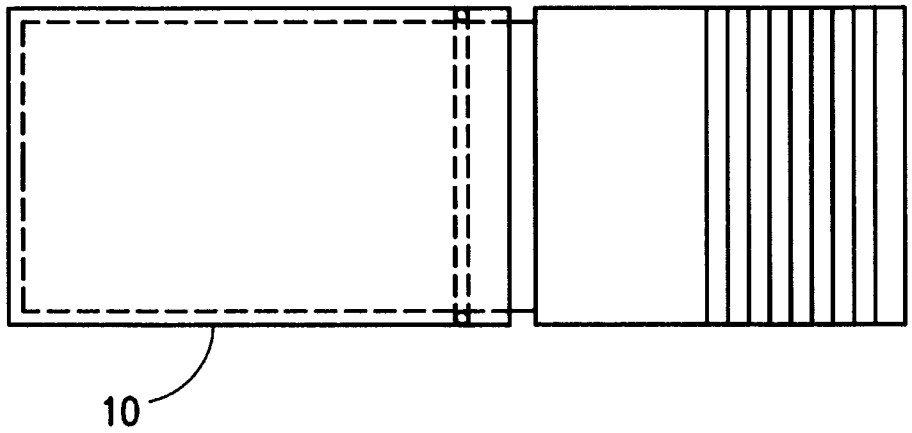
FIG. 6 shows the applicator of FIG. 5 in combination with a curler.
Figure 7:
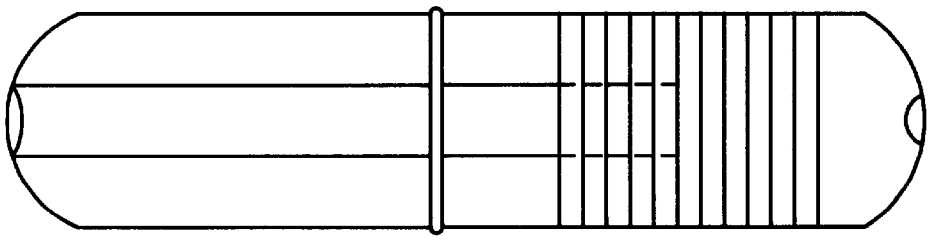
FIGS. 7–10 are plan views of variations of the applicator shown in FIG. 5.
Figure 8:
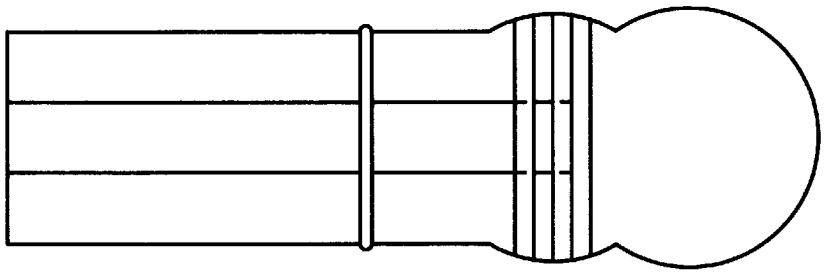
Figure 9:
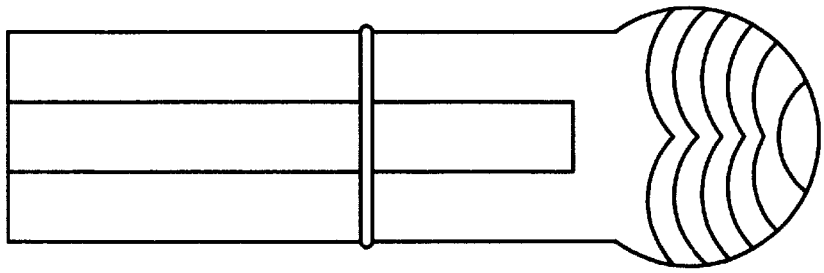
Figure 10:
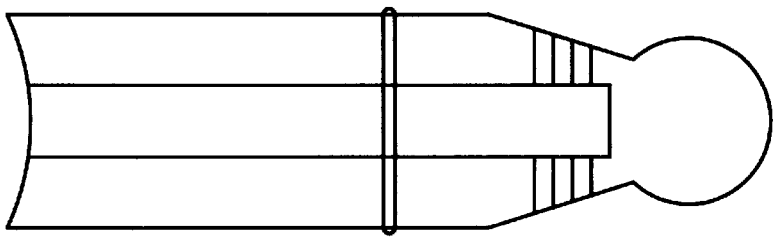

The curler 10 is inserted onto the applicator 40 prior to curling the hair. With the roller inside the curler, the hair dresser winds the curler with a first hand until it is self-anchored in the hair, after which the roller is detached by sliding it out as follows: with the opposite hand, the hair dresser's forefinger presses on the inner surface of the roller, and the thumb presses on the outer surface. The roller and the anchored hair are thus pressed between the thumb and forefinger. Using the pressure on the roller and a simultaneous pulling motion by the forefinger against the thumb, the roller slides out. Halfway along the detachment of the roller, the thumb lifts off to hold the roller with the forefinger. The thumb and forefinger of the first hand continue to hold the curler in place until the applicator is completely removed.

Where the curlers are to be applied to the users own hair, an applicator 50 as shown in FIG. 5 and FIG. 6 is used. Applicator 50 is typically formed from a hollow cylinder of hard rubber or resilient plastic at least about 2 mm in thickness and is divided into two portions, a roller portion 52 and a handle portion 54, divided by a transverse ridge 56. The roller portion is about the same length as the curler 10, but may be slightly longer, about 1 mm. The diameter of the roller portion is slightly less than that of the curler, about 0.3 to 1 mm less.

A pair of opposed longitudinal depressions or ridges 58 are formed in the surface of the roller, these depressions or ridges extending throughout the length of the roller portion into the handle portion, and terminating toward the end of the handle portion. These depressions or ridges are about to 2–10 mm wide; the depressions are about 0.5 mm deep, the ridges up to about 1.0 mm thick, preferably 0.5–1 mm.

In order to aid gripping of the handle, a plurality of ridges 60 may be provided thereupon. As shown in the figures, the ridges may be transverse, but could also be longitudinal as shown in FIG. 3.

As shown in FIGS. 5 and 6, the handle is merely a continuation of the roller portion. Alternatively, as shown in FIGS. 7–10, the handle may be of various other shapes especially shapes intended to be distinctive or attractive. The handle should be at least six centimeters in length.

This applicator is used as follows: with one hand, the thumb and another finger grasp the opposed depressions on the handle portion and squeeze the applicator, thereby reducing its diameter. The roller portion is then inserted into the curler, the pressure is removed from the depressions and the hair is wound around the curler. The applicator can then be detached by applying pressure to the depressions, thus reducing the diameter of the roller portion. Once again, the fingers of the opposite hand hold the hair and curler until the roller is completely detached.

What is claimed is:

1. A hair curler and an applicator for applying the hair curler to hair, the hair curler comprising a flexible hollow cylinder of predetermined length and diameter having an external surface and an internal surface, and having a plurality of filaments protruding from the external surface, said filaments constructed and arranged to grip hair, said applicator comprising a hollow cylinder of substantially rigid material having a diameter smaller than said predetermined diameter by an amount sufficient to allow the applicator to slide freely within the hair curler such that the applicator is removable from the hair curler, the applicator having a length at least substantially equal to said predetermined length, said applicator comprising on opposite longitudinal ends thereof means to assist gripping of the applicator.

2. The hair curler and applicator of claim 1, wherein the applicator comprises a plastic of about 1–2 mm in thickness.

3. The hair curler and applicator of claim 1, wherein the applicator has a diameter about 1.5–2 mm smaller than said predetermined diameter.

4. The hair curler and applicator of claim 1, wherein said applicator has a length about 1–2 cm greater than said predetermined length.

5. The hair curler and applicator of claim 1, wherein the hair curler is formed from a fabric or tape wound into a cylinder and secured along a longitudinal seam with stitching or adhesive.

6. The hair curler and applicator of claim 1, wherein the hair curler has an end portion wound on itself, and secured with stitching or adhesive.

7. The hair curler and applicator of claim 1, wherein the means to aid gripping comprises a plurality of longitudinal or transverse depressions.

8. A hair curler and an applicator for applying the hair curler to hair, the hair curler comprising a flexible hollow cylinder of predetermined length and diameter having an external surface and an internal surface, and having a plurality of filaments protruding from the external surface, said filaments constructed and arranged to grip hair, said applicator comprising a hollow cylinder of resilient material having a diameter smaller than said predetermined diameter by an amount which does not permit the hair curler to slide freely thereon, said applicator comprising a roller portion and a handle portion, separated by a transverse ridge, and further comprising a pair of opposed longitudinal ridges of thickness sufficient or a pair of opposed longitudinal depressions of a depth sufficient that pressure applied to said depressions or ridges causes a reduction in the diameter of the applicator by an amount sufficient to permit the hair roller to slide freely on the roller portion thereof, said handle portion comprising a means to aid gripping of the handle.

9. The hair curler and applicator of claim 8, wherein the applicator comprises a hard rubber of resilient plastic of at least about 2 mm in thickness.

10. The hair curler and applicator of claim 8, wherein the applicator has a diameter about 0.3–1 mm smaller than said predetermined diameter.

11. The hair curler and applicator of claim 8, wherein said roller portion has a length about 0–2 mm greater than said predetermined length, and said handle portion is at least about 6 cm in length.

12. The hair curler and applicator of claim 8, wherein the hair curler is formed from a fabric or tape wound into a cylinder and secured along a longitudinal seam with stitching or adhesive.

13. The hair curler and applicator of claim 8, wherein the hair curler has an end portion wound on itself, and secured with stitching or adhesive.

14. The hair curler and applicator of claim 8, wherein the means to aid gripping comprises a plurality of longitudinal or transverse depressions.

15. The hair curler and applicator of claim 8, wherein the opposed longitudinal depressions have a depth of about 0.5 mm.

16. The hair curler and applicator of claim 8, wherein the opposed longitudinal ridges have a thickness of about 0.5–1 mm.

* * * * *